US006495028B1

(12) United States Patent
Xu et al.

(10) Patent No.: US 6,495,028 B1
(45) Date of Patent: Dec. 17, 2002

(54) CATALYTIC CONVERSION PROCESS FOR PRODUCING ISOBUTANE AND ISOPARAFFIN-ENRICHED GASOLINE

(75) Inventors: Youhao Xu, Beijing (CN); Jiushun Zhang, Beijing (CN); Yinan Yang, Beijing (CN); Jun Long, Beijing (CN); Xieqing Wang, Beijing (CN); Zaiting Li, Beijing (CN); Raichi Zhang, Beijing (CN)

(73) Assignees: China Petroleum Corporation, Beijing (CN); Research Institute of Petroleum Processing, Beijing (CN)

( * ) Notice: Subject to any disclaimer, the term of this patent is extended or adjusted under 35 U.S.C. 154(b) by 0 days.

(21) Appl. No.: 09/556,079

(22) Filed: Apr. 21, 2000

(30) Foreign Application Priority Data

Jun. 23, 1999 (CN) ..... 99109193 A

(51) Int. Cl.[7] ..... C10G 57/00

(52) U.S. Cl. ..... 208/69; 208/118; 208/120.01; 208/70; 585/734

(58) Field of Search ..... 208/118, 120.01, 208/69, 70; 585/734

(56) References Cited

U.S. PATENT DOCUMENTS

| | | | | |
|---|---|---|---|---|
| 4,090,948 A | | 5/1978 | Schwarzenbek | 208/74 |
| 5,154,818 A | | 10/1992 | Harandi et al. | 208/74 |
| 5,271,826 A | * | 12/1993 | Krambeck et al. | 208/113 |
| 5,389,232 A | * | 2/1995 | Adewuyi et al. | 208/120 |
| 5,486,284 A | * | 1/1996 | Degnan et al. | 208/120 |

* cited by examiner

*Primary Examiner*—Nadine Preisch
(74) *Attorney, Agent, or Firm*—Morrison & Foerster LLP

(57) ABSTRACT

A process for catalytic conversion of hydrocarbon feedstock to produce isobutane and isoparaffin-enriched gasoline which comprises two different reactions, the preheated feedstock is contacted with hot regenerated catalyst in the lower part of a reactor with the result that catalytic cracking reaction takes place, and the mixture of vapors and the coke deposited catalyst are up-flowed and enter into a suitable reaction environment with the result that isomerization and hydrogen transfer reaction take place. The produced LPG has an isobutane content of about 20 wt % to about 40 wt % and the produced gasoline contains isoparaffin content of about 30 wt % to about 45 wt % and olefin content of less than 30 wt %. RON and MON of the gasoline are 90~93 and 80~84 respectively.

27 Claims, 2 Drawing Sheets

CATALYTIC CONVERSION PROCESS FOR PRODUCING ISOBUTANE AND ISOPARAFFIN-ENRICHED GASOLINE

BACKGROUND OF THE INVENTION

This invention relates to a process for catalytic conversion of hydrocarbon feedstock in the absence of added hydrogen. More particularly, the present invention relates to a catalytic conversion process for producing isobutane and isoparaffin-enriched gasoline.

The mixture of isoparaffins possessing high octane number, low octane sensitivity, appropriate volatility and clean burning is an ideal blending components for aviation gasoline and motor gasoline. The mixture of isoparaffins can be obtained by propylene polymerization or alkylation reaction of isobutane and olefins.

The conventional fluidized catalytic cracking (FCC) technology is used for producing gasoline with a yield of up to 50 wt %. In the 1980s, the phase down of leaded gasoline forced the catalytic cracking technology to go forward to the production of high octane gasoline. The changing market demands have resulted in a great change in technology and catalyst types. The advance in technological development is to increase reaction temperature, shorten reaction time, intensify reaction severity, suppress hydrogen transfer reaction and overcracking reaction and improve the contacting efficiency between feedstock and hot catalyst at the bottom of a riser reactor. In catalyst development, the catalysts containing USY zeolite supported on an inert or active matrix or containing different typed zeolites have been put into commercial use.

Though FCC technology has been advanced to meet octane blending requirement, whether it is by means of changing in process parameters or using novel catalysts for increasing gasoline octane number, it results in an increase in olefin content of FCC gasoline. Apparently, there is a great difference between the olefin contents of about 35 wt %~65 wt % in FCC gasoline and that required for reformulated gasoline (RFG). FCC liquid petroleum gas (LPG) has an olefin content of up to 70 wt %, in which butylenes is several times as much as the yield of isobutane, so it is not fit to be used as feedstock for alkylation.

U.S. Pat. No. 5,154,818 discloses a method for the fluidized catalytic cracking of plural hydrocarbon feedstocks in a riser reactor to produce more gasoline of high octane number. The process generally comprises two reaction zones. A relatively light hydrocarbon feedstock contacts with spent catalyst in a first reaction zone located in the bottom of a conventional riser where aromatization and oligomerization take place. All of the first reaction zone effluent, the regenerated catalyst and heavy hydrocarbon feedstock are introduced into the second reaction zone where heavy hydrocarbon feedstock is cracked to desired reaction products. The reaction products and spent catalyst then pass through disengager for removal of entrained catalyst before the hydrocarbon vapors pass into a separation system. Spent catalyst passes into stripper and is divided into two parts, one is introduced into regenerator for burning off coke, the other part is recycled to the first reaction zone.

U.S. Pat. No. 4,090,948 discloses a catalytic cracking process for producing the desired conversion of hydrocarbon feedstock of inferior quality (having higher contents of basic nitrogen and carbon residue) to obtain higher yields of the desired products in a riser reactor. The process generally comprises contacting the hydrocarbon feedstock containing the highly reactive nitrogen and carbon residue with a recycled spent catalyst in the first reaction zone where the highly reactive nitrogen and carbon residue will deposit on the spent catalyst and then contacting the resultant mixture with freshly regenerated catalyst in the second reaction zone. The reaction products and spent catalyst then pass through disengager for removal of entrained catalyst before the hydrocarbon vapors pass into a separation system. Spent catalyst passes into stripper and is divided into two parts, one is introduced into regenerator for burning off coke and then returned to the second reaction zone, and the other part is recycled without regeneration to the first reaction zone.

Though the above two prior art processes have divided an iso-diameter riser reactor into two reaction zones, the reactions take place at lower temperature in the first reaction zone and the reactions take place at higher temperature in the second reaction zone. In addition, the processes utilize a conventional riser reactor without flexibility for adjusting operating conditions. This arrangement is subject to significant disadvantages to carry on catalytic cracking reaction and selective hydrogen transfer at the same time for producing LPG with higher yield of isobutane and isoparaffin enriched gasoline.

An object of the present invention is to provide a catalytic conversion process for producing isobutane and isoparaffin-enriched gasoline to meet the requirement for blending components of the RFG, i.e., limiting the olefin content on the premise of maintaining higher gasoline octane number.

SUMMARY OF THE INVENTION

The process provided by the present invention is to contact the preheated hydrocarbon feedstock with hot regenerated catalyst in the lower part of a reactor with the result that hydrocarbon cracking reaction takes place at higher reaction temperature and shorter reaction time, and then the resultant mixture is up-flowed and enters into a suitable reaction environment with the result that isomerization and hydrogen transfer reaction take place at lower reaction temperature and longer reaction time. The reaction products and spent catalyst that pass through disengager for removal of entrained catalyst. The reaction products flow into subsequent separation system. Spent catalyst is stripped with steam, and then flow into the regenerator for regeneration, and thereafter the hot regenerated catalyst is recycled to the lower part of the reactor.

The process provided by the present invention employs a reactor to carry on two different reactions under different operating conditions, said reactor is preferably selected from the group consisting of an iso-diameter riser, an iso-linear velocity riser, a multi-cascade riser, a fluidized bed or a combination reactor of an iso-diameter riser and a fluidized bed.

The applicants have found that the olefins produced by catalytic cracking reaction can be selectively converted into isoparaffins and aromatics or isoparaffins and coke under specific reaction conditions and with specific catalysts.

The present invention is practiced by different embodiments. In embodiment one, the invention is a process comprising: the preheated hydrocarbon feedstock is atomized with injection steam and charged into the bottom of a conventional iso-diameter riser, and then mixed with hot regenerated catalyst with the result that feedstock is vaporized and cracked. The product vapors and the coke deposited catalyst are up-flowed and are mixed with cooled regenerated catalyst with the result that isomerization and hydrogen transfer reaction take place. The reaction vapors and catalyst flow into disengager where entrained catalyst is separated and dropped into the catalyst stripper. The reaction vapors are separated into products in subsequent separation system. Spent catalyst is stripped and introduced into regenerator for regeneration. Regenerated catalyst is divided into two parts, one is recycled into the prelift zone of the riser, and the other part is cooled in catalyst cooler and then recycled into the second reaction zone.

In embodiment two, this invention is a process comprising: the preheated hydrocarbon feedstock is atomized with injection steam and charged into the bottom of a convention iso-diameter riser, and then mixed with hot regenerated catalyst with the result that the feedstock is vaporized and cracked. The product vapors and the coke deposited catalyst are up-flowed and are mixed with cooled semi-regenerated catalyst with the result that isomerization and hydrogen transfer reaction take place. The reaction vapors and catalyst flow into disengager where entrained catalyst is separated and dropped into the catalyst stripper. The reaction vapors are separated into products in subsequent separation system. Spent catalyst is stripped and introduced into the primary regenerator for regeneration. Semi-regenerated catalyst is divided into two parts, one flows into the secondary regenerator for regeneration, and then is recycled into the prelift zone of the riser, and the other part is cooled in catalyst cooler and then recycled into the second reaction zone.

In embodiment three, this invention is a process comprising: the preheated hydrocarbon feedstock is atomized with injection steam and charged into the bottom of the riser in a combination reactor of an iso-diameter riser and a fluidized bed, and then mixed with hot regenerated catalyst with the result that the feedstock is vaporized and cracked. The product vapors and the coke deposited catalyst in the riser flow upward and are mixed with cooled regenerated catalyst with the result that isomerization and hydrogen transfer reaction take place in the fluidized bed. The reaction vapors and catalyst flow into disengager where entrained catalyst is separated and dropped into the catalyst stripper. The reaction vapors are separated into products in subsequent separation system. Spent catalyst is stripped and introduced into regenerator for regeneration. Regenerated catalyst is divided into two parts, one is recycled into the prelift zone of the riser, and the other part is cooled in catalyst cooler and then recycled into the fluidized bed.

In a more preferred embodiment of this invention, this invention comprises that the preheated hydrocarbon feedstock is atomized with injection steam and charged into the bottom of the first reaction zone in a multi-cascade riser, and then mixed with hot regenerated large particle size distribution catalyst containing USY zeolite with the result that feedstock is vaporized and cracked, providing the lifting force to carry the product vapors and the coke deposited catalyst in the first reaction zone into the second reaction zone where the effluents are mixed with the cooled regenerated small particle size distribution catalyst containing rare-earth Y zeolite with the result that isomerization and hydrogen transfer reaction take place. The reaction vapors and catalyst flow into disengager where entrained catalyst is separated and dropped into the catalyst stripper. The reaction vapors are separated into products in subsequent separation system. Spent catalyst is stripped and introduced into regenerator for regeneration. Regenerated catalyst is divided into the large particle size distribution catalyst and the small particle size distribution catalyst, the large particle size distribution catalyst is recycled into the prelift zone of the riser, and the small particle size distribution catalyst is cooled in catalyst cooler and then recycled into the second reaction zone.

The above embodiments are not meant to limit the present invention to the details disclosed herein.

DETAILED DESCRIPTION OF THE INVENTION

Figure 1:
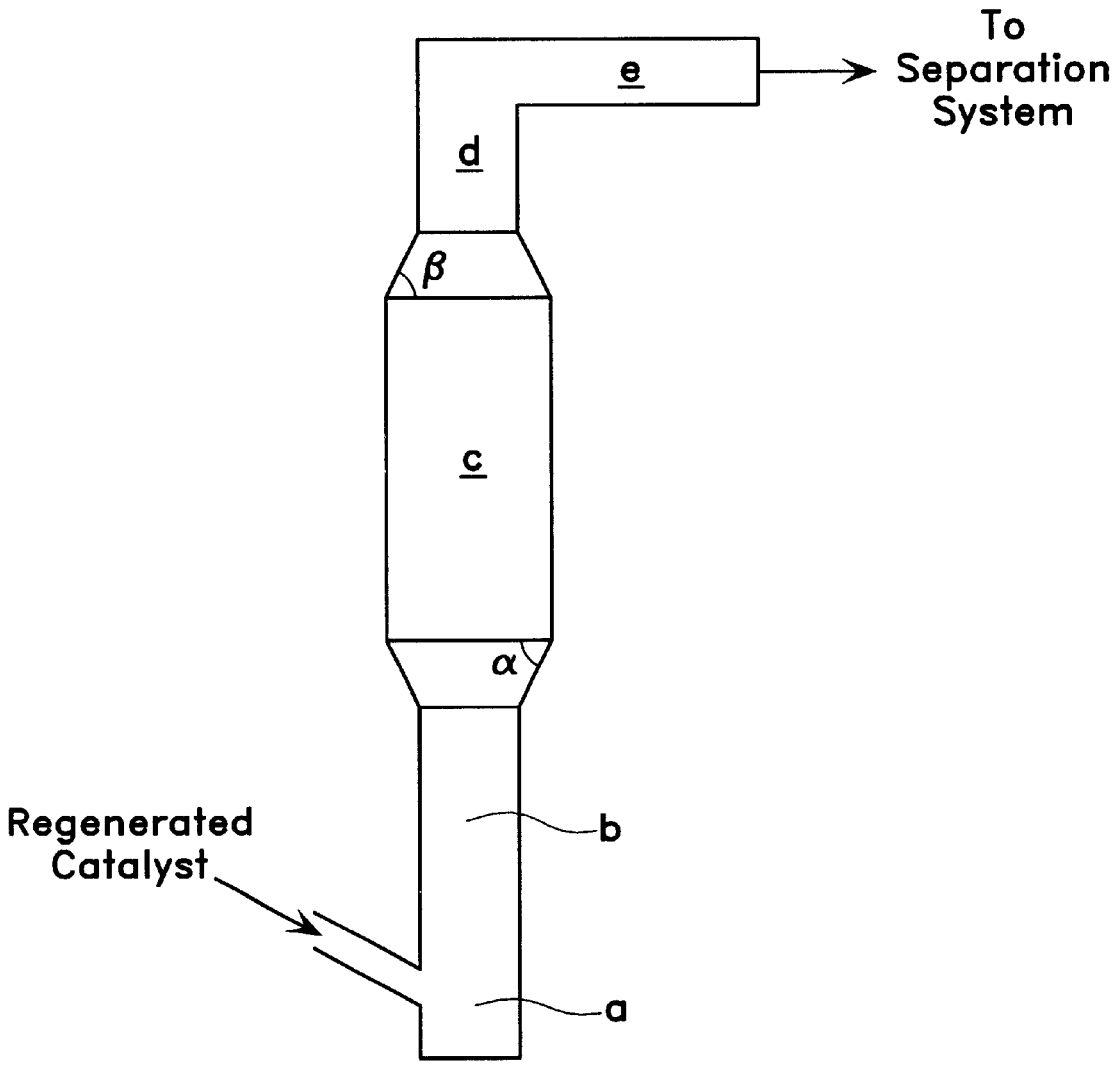
FIG. 1 shows a schematic diagram of the more preferred reactor used for carrying out the process of the present invention, comprising prelift zone a, the first reaction zone b, the second reaction zone c, outlet zone d, and horizontal tube e.

The process of the present invention comprises the steps as follows:

1. The preheated hydrocarbon feedstock is charged to the bottom of a reactor and contacted with hot regenerated catalyst with the result that they are vaporized and cracked. Catalytic cracking reaction temperature is preferably from about 530° C. to about 620° C., and even more preferably from about 550° C. to about 600° C., the reaction time is preferably from about 0.5 second to about 2 seconds, and even more preferably from about 0.8 second to about 1.5 seconds, the weight ratio of catalyst to feed (hereinafter referred to as C/O ratio) is preferably from about 3:1 to about 15:1, and even more preferably from about 4:1 to about 12:1.

2. The product vapors and the coke deposited catalyst are up-flowed and enter into a suitable reaction environment with the result that isomerization and hydrogen transfer reaction take place. The reaction temperature is preferably from about 420° C. to about 550° C., and even more preferably from about 460° C. to about 510° C., the reaction time is preferably from about 2 seconds to about 30 seconds, and even more preferably from about 3 seconds to about 15 seconds, the C/O ratio is preferably from about 3:1 to about 18:1, and even more preferably from about 4:1 to about 15:1. The weight ratio of steam to feed (hereinafter referred to as S/O ratio) is preferably from about 0.03:1 to about 0.3:1, and even more preferably from about 0.05:1 to about 0.3:1, and the reaction pressure is preferably about 130 kPa to 450 kPa in reaction zone.

3. Product vapors are separated into LPG with high yield of isobutane, isoparaffin enriched gasoline and other products. Spent catalyst is dropped into the catalyst stripper and then introduced to regenerator for regeneration, and thereafter the hot regenerated catalyst is recycled into the first reaction zone.

The process provided by the present invention employs a reactor to carry on two different reactions under different operating conditions; it is preferably selected from the group consisting of an iso-diameter riser, an iso-linear velocity riser, a multi-cascade riser, a fluidized bed or a combination of an iso-diameter riser and a fluidized bed.

When the process of the present invention is carried out in an iso-diameter riser reactor which is same as a conventional riser reactor used in a refinery or an iso-linear velocity riser reactor in which the velocity of fluid is approximately even or a fluidized bed reactor. The iso-diameter riser or iso-linear velocity riser is divided into a prelift zone, a first reaction zone, a second reaction zone from bottom to top, while the fluidized bed reactor comprises only a first reaction zone and a second reaction zone. The height ratio of the reaction zone to the second reaction zone is 10~40:90~60. One inlet or multi-inlets of quenching mediums is set up at the bottom of the second reaction zone, and/or a heat remover having a height of about 50%~90% of that of the second reaction zone is located in the second reaction zone for adjusting the reaction temperature and time in the reaction zone. As the term used herein, said quenching medium is generally one or more selected from the group consisting of quenching liquid, cooled regenerated catalyst, cooled semi-regenerated catalyst or fresh catalyst or the mixtures thereof, in which quenching liquid is preferably selected from the group consisting of LPG, naphtha, stabilized gasoline, light cycle oil (LCO), heavy cycle oil (HCO) or water or the mixtures thereof. LPG, naphtha and gasoline having high olefin content can not only act as quenching mediums, but also participate in reaction. The cooled regenerated and semi-regenerated catalysts are obtained by cooling catalyst through catalyst cooler after the primary stage and secondary stage regeneration respectively. As the terms used herein, said regenerated catalyst refers to catalyst that has a residual carbon content of below 0.1 wt %, more preferably below and 0.05 wt %, and said semi-regenerated catalyst refers to catalyst that has a residual carbon content of from about 0.1 wt % to about 0.9 wt %, more preferably from about 0.15 wt % to about 0.7 wt %.

When the process of the present invention is carried out in a combination reactor of an iso-diameter riser and a fluidized bed, wherein the lower iso-diameter riser refers to the first reaction zone, the upper fluidized bed refers to the second reaction zone. One inlet or multi-inlets of quenching remover having a height of about 50%~90% of that of the second reaction zone is located in the second reaction zone for adjusting the reaction temperature and time in the reaction zone. As the term used herein, said quenching medium is generally one or more selected from the group consisting of quenching liquid, cooled regenerated catalyst, cooled semi-regenerated catalyst or fresh catalyst or the mixtures thereof, in which quenching liquid is preferably selected from the group consisting of LPG, naphtha, stabilized gasoline, light oil (LCO), heavy cycle oil (HCO) or water or the mixtures thereof. LPG, naphtha and gasoline having high olefin content can not only act as quenching mediums, but also participate in reaction. The cooled regenerated and semi-regenerated catalysts are obtained by cooling catalyst through catalyst cooler after the primary stage and secondary stage regeneration respectively. As the terms used herein, said regenerated catalyst refers to catalyst that has a residual carbon content of below 0.1 wt %, more preferably below about 0.05 wt %, said semi-regenerated catalyst refers to catalyst that has a residual carbon content of from about 0.1 wt % to about 0.9 wt %, more preferably from about 0.15 wt % to about 0.7 wt %.

When the process of the present invention is carried out in a multi-cascade riser reaction, of which the structural features are shown in FIG. 1, the riser consists of a prelift zone a, a first reaction zone b, a second reaction zone with enlarged diameter c, the outlet zone with reduced diameter d from bottom to top along the coaxial direction. The end of outlet zone is connected to a horizontal tube e. The conjunct section between the first reaction zone and the second reaction zone is a circular truncated cone whose vertical section isotrapezia vertex angle a is generally 30°~80°. The conjunct section between the second reaction zone and the outlet zone is a circular truncated cone whose vertical section isotrapezia base angle β is generally about 450°~850°.

The total height of the riser is generally from about 10 meters to about 60 meters. The diameter of the prelift zone is the same as that of a conventional iso-diameter riser and generally from about 0.02 meter to about 5 meters. The height of the prelift zone is about 5%~10% of the total height of the riser. The function of this zone is to lift regenerated catalyst upward and to improve initial feed and catalyst contacting with the aid of a prelift medium that is selected from steam or dry gas same as that used in a conventional iso-diameter riser reactor.

The structure of the first reaction zone of the riser is similar to the lower section of a conventional iso-diameter riser. Its diameter is equal to or greater than that of the prelift zone. The diameter ratio of the former to the latter is generally from about 1:1 to about 2:1. The height of the first reaction zone is about 10%~30% of the total height of the riser. The preheated feedstocks are atomized with injection steam and charged into this section, and then mixed with hot regenerated catalyst with result that cracking reaction takes place at higher reaction temperature and CIO ratio and shorter reaction time.

The diameter of the second reaction zone is greater than that of the first reaction zone. The diameter ratio of the former to the latter is generally from about 1.5:1 to about 5:1. The height of the second reaction zone is about 30°~60° of the total height of the riser. The function of this zone is to reduce the velocity of vapors and catalyst and the reaction temperature in order to suppress cracking reaction and increase isomerization reaction and hydrogen transfer reaction. The method of controlling the second reaction temperature is to inject quenching mediums at the conjunct section between the first reaction zone and the second reaction zone and/or to install a heat remover in the zone. The height of the heat remover is generally from abut 50% to about 90% of that of the second reaction zone. The zone temperature is generally from about 420° C. to about 550° C. The contacting time of vapor and catalyst is generally from about 2 seconds to about 30 seconds. As the term used herein, said quenching medium is generally one or more selected from the group consisting of quenching liquid, cooled regenerated catalyst, cooled semi-regenerated catalyst or fresh catalyst or the mixtures thereof, in which quenching liquid is preferably selected from the group consisting of LPG, naphtha, stabilized gasoline, light cycle oil (LCO), heavy cycle oil (HCO) or water or the mixtures thereof. LPG, naphtha and gasoline having high olefin content can not only act as quenching mediums, but also participate in reaction. The cooled regenerated and semi-regenerated catalysts are obtained by cooling catalyst through catalyst cooler after the primary stage and secondary stage regeneration respectively. As the terms used herein, said regenerated catalyst refers to catalyst that has a residual carbon content of below 0.1 wt %, more preferably below about 0.05 wt %, and said semi-regenerated catalyst refers to catalyst that has a residual carbon content of from about 0.1 wt % to about 0.9 wt %, more preferably from about 0.15 wt % to about 0.7 wt %.

The structure of the outlet zone is similar to that of a conventional iso-diameter riser. The diameter ratio of the outlet zone to the first reaction zone is generally about 0.8:1 to about 1.5:1. The height of this zone is generally about 0~20% of total height of the riser. The function of this zone is to increase effluent velocity and to suppress overcracking reaction.

One end of the horizontal tuber is connected to the outlet zone and the other end is connected to the disengager. When the height of the outlet zone is equal to zero, one end of the horizontal tube is connected to the second reaction zone and the other end is connected to the disengager. The function of the horizontal tube is to link the outlet zone with the disengager.

Feedstocks suitable for the process of the present invention include distillate having different boiling ranges, residue and crude. More specifically, the feedstocks are selected from the group consisting of atmospheric gas oil, naphtha, catalytic gasoline, diesel, vacuum gas oil (VGO), atmosphere residue (AR) or vacuum residue (VR), coker gas oil (CGO), deasphalted oil (DAO), hydrotreated residue, hydrocracked residue, shale oil or the mixtures of thereof.

The process of the present invention are adaptable for use with all known catalysts types, including amorphous silica-alumina catalysts and zeolite catalysts with the active components preferably selected from the group consisting of Y, HY, USY or ZSM-5 series or any other zeolites typically employed in the cracking of hydrocarbons with or without rare earth and/or phosphor or the mixtures thereof.

The different reaction zones in the processes of the present invention are adaptable for use with the different type catalysts, including large and small particle size distribution catalysts or high and low apparent bulk density catalysts with the active components preferably selected from the group consisting of Y, HY, USY or ZSM-5 series or any other zeolites typically employed in the cracking of hydrocarbons with or without rare earth and/or phosphor or mixtures thereof. Large and small particle size distribution catalysts or high and low apparent bulk density catalysts flow into different reaction zones respectively. For example, the large particle size distribution catalyst with USY zeolite flows into the first reaction zone for increasing cracking reaction, while the small particle size distribution catalyst with rare earth Y zeolite flows into the second reaction zone for increasing hydrogen transfer reaction. The mixed large and small particle size distribution catalysts are stripped in a stripper and are combusted in a regenerator, and then are separated into large particle size distribution catalyst and small particle size distribution catalyst. The large and small particle size distribution catalysts are partitioned with the range of about 30~40 $\mu$m. The high and low apparent bulk density catalyst are partitioned within the range of about 0.6~0.7 g/cm$^3$.

The present invention has several important advantages in that:

1. When the present invention is carried out in a conventional iso-diameter riser or a fluidized bed reactor, the object of this invention is obtained by reducing throughput capacity and controlling low reaction temperature.

2. The multi-cascade riser reactor used in the present invention has advantages in that the cracking reaction at the bottom of the riser take place at higher reaction temperature and C/O ratio, meanwhile, overcracking reaction and thermal reaction are suppressed at the top of the riser, while isomerization and hydrogen transfer reaction take place in the middle section of the riser at lower reaction temperature and longer reaction time.

3. The process provided by the present invention produces LPG having an isobutane content of about 20~40 wt % and gasoline having an isoparaffin content of about 30~45 wt %, and olefin content of below 30 wt %, whereas the conventional iso-diameter riser catalytic cracking produces LPG having an isobutane content of below 20 wt %, and olefin content of above 40 wt %. 4. The process of the present invention is adaptable for different hydrocarbon feedstocks and different type catalysts.

Figure 2:
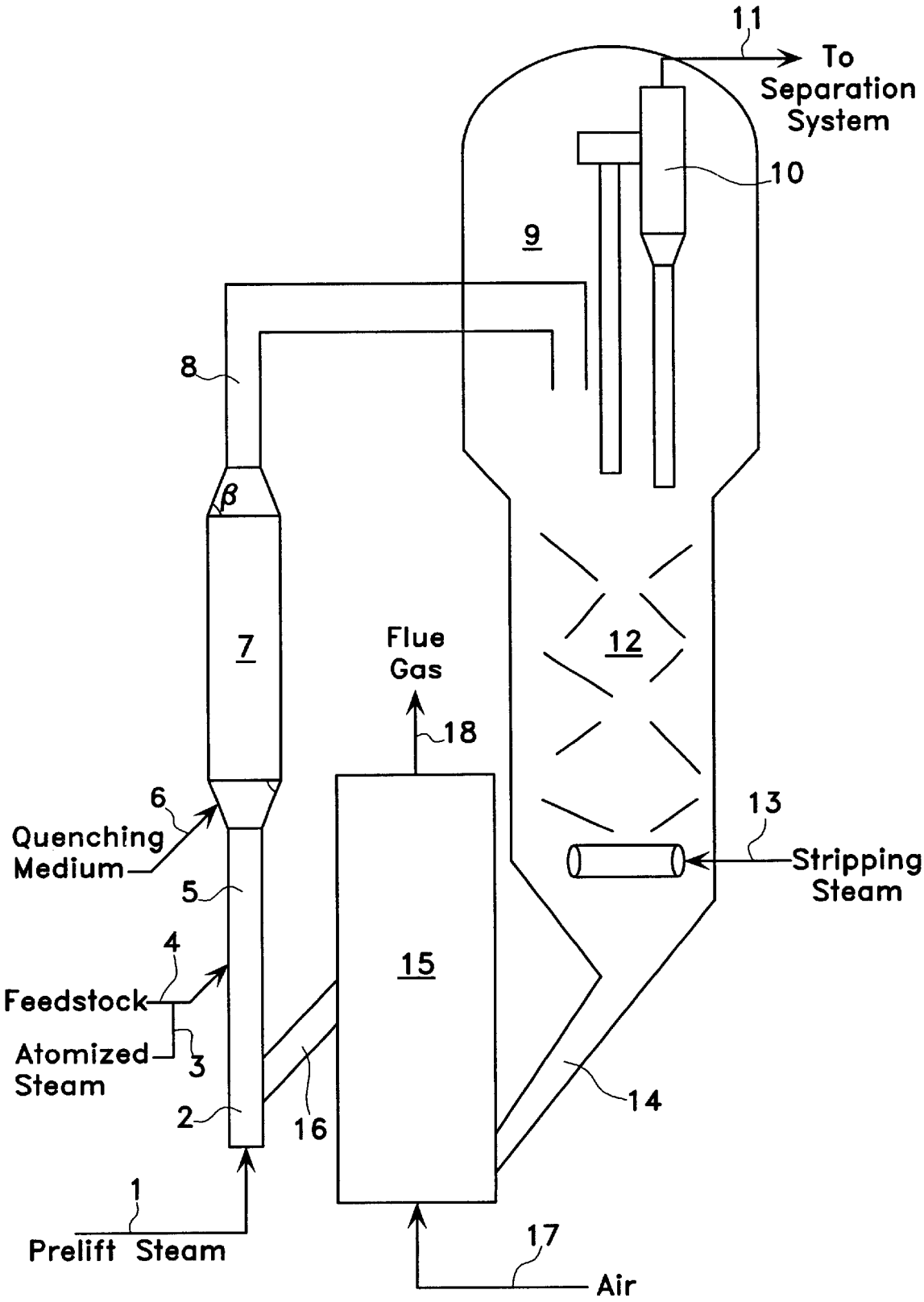
FIG. 2 shows the more preferred schematic flow diagram used for carrying out this invention, comprising conduits 1, 3, 4, 6, 11, 13, 17 and 18, prelift zone 2, the first reaction zone 5, the second reaction zone 7, outlet zone 8, disengager 9, cyclone 10, stripper 12, catalyst standpipe 14, regenerator 15, and regenerated catalyst standpipe 16.

The following description of the more preferable practicing mode is more fully explained in the context of attached FIG. 2.

FIG. 2 shows the schematic flow diagram used to produce isobutane and isoparaffin enriched gasoline in a multi-cascade riser. The shape and size of the apparatus and pipelines are not limited in the attached diagram but depend on specific embodiments.

The prelift steam is introduced into prelift zone 2 via conduit 1. Hot regenerated catalyst flow into prelift zone 2 via regenerated catalyst standpipe 16 and is lifted by prelift steam. The preheated feedstock via conduit 4 is mixed with atomized steam via conduit 3 in proportion to form a mixture. The mixture is charged into prelift zone, and then is contacted with hot regenerated catalyst, flowing into the first reaction zone 5 where cracking reaction takes place under certain reaction conditions. The effluent is mixed with quenching mediums via conduit 6, flowing into the second reaction zone 7 with the result that isomerization and hydrogen transfer reaction take place under certain reaction conditions. The reacted effluent flows into outlet zone 8 where the effluent is accelerated, and then passes through disengager 9, where entrained catalyst is separated and dropped into the catalyst stripper 12. Residual catalyst is separated from the reaction vapors in a set of cyclones 10 located in the upper section of the reactor. The reaction vapors pass to subsequent separation system via conduit 11. Spent catalyst is contacted with stripping steam via conduit 13 to remove heavy hydrocarbons on the catalyst. After steam stripping, the catalyst flows to the spent catalyst standpipe 14 to the regenerator 15, where the spent catalyst is contacted with air via conduit 17 with the result that catalyst regeneration takes place to burn off coke. Flue gas is discharged from the regenerator via conduit 18. The hot regenerated catalyst is recycled into the bottom of the riser via regenerated catalyst standpipe 16.

EXAMPLES

The following examples are used to demonstrate the efficacy of the present invention and are not meant to limit the scope of the invention to the detail examples shown herein. The properties of the feedstocks and catalysts used in practical examples and comparative examples are listed in tables 1 and 2 respectively. The catalysts listed in table 2 are manufactured by the catalyst complex of Qilu Petrochemical Corporation, SINOPEC.

Example 1

The example showed that hydrocarbon feedstock was converted to produce isobutane and isoparaffin enriched gasoline in a conventional pilot plant iso-diameter riser in accordance with the present invention.

The preheated hydrocarbon feedstock D listed in table 1 was charged into the riser and contacted with hot regenerated catalyst D listed in table 2 in the presence of steam with the result that some reactions took place. The reaction products were separated into isobutane enriched LPG, isoparaffin enriched gasoline and other products. Spent catalyst flowed into regenerator via stripping. After regeneration, the regenerated catalyst was recycled for use.

Operating conditions and product slate were listed in table 3. Gasoline properties were listed in table 4. Table 3 showed that 20.72 wt % of LPG was isobutane. Table 4 showed that the gasoline had an isoparaffin content of 31.92 wt %, whereas olefin content was 29.32 wt %.

Comparative Example 1

Compared with example 1, the reaction time reduced from 5.5 seconds to 3.5 seconds, while other operating conditions were similar in the example. Operating conditions and product slate were listed in table 3. Gasoline properties were listed in table 4. Table 3 showed that 8.95 wt % of LPG was isobutane. Table 4 showed that the gasoline had an isoparaffin content of 22.06 wt %, and an olefin content of 47.65 wt %.

Example 2

The example showed that hydrocarbon feedstock was converted to produce isobutane and isoparaffin enriched gasoline in a combination reactor of an iso-diameter riser and a fluidized bed in accordance with the present invention.

The preheated hydrocarbon feedstock D listed in table 1 was charged into the riser and contacted with hot regenerated catalyst D listed in table 2 in the presence of steam with the result that some reactions took place. The reaction products were separated into isobutane enriched LPG, isoparaffin enriched gasoline and other products. Spent catalyst flowed into regenerator via stripping. After regeneration, the regenerated catalyst was recycled for use.

Operating conditions and product slate and gasoline properties were listed in table 5. Table 5 showed that 32.04 wt % of LPG was propylene, 23.20 wt % of LPB was isobutane, and that the gasoline had an isoparaffin content of 30.16 wt %, and an olefin content of 28.63 wt %.

Comparative Example 2

The comparative example was conducted in a conventional pilot plant iso-diameter riser reactor. The catalyst and feedstock used were the same as that in example 2. Operating conditions, product slate and gasoline properties were listed in table 5. Table 5 showed that 32.80 wt % of LPG was propylene, 7.76 wt % of LPG was isobutane, and that the gasoline has an isoparaffin content of 17.30 wt %, and an olefin content of 45.30 wt %.

Example 3

The example showed that hydrocarbon feedstock was converted to produce isobutane and isoparaffin enriched gasoline in a multi-cascade riser reactor in accordance with the present invention.

The total height of the multi-cascade riser is 15 meters in which the height of the prelift zone with a diameter of 0.025 meter is 1.5 meters, the height of the first reaction zone with a diameter of 0.025 meter is 4 meters, the height of the second reaction zone with a diameter of 0.1 meter is 6.5 meters, and the height of the outlet zone with a diameter of 0.025 meter is 3 meters. The isotrapezia vertex angle $\alpha$ of the vertical section of the conjunct section between the first reaction zone and the second reaction zone is about 45°, and the isotrapezia base angle $\beta$ of the vertical section of the conjunct section between the second reaction zone and the outlet zone is about 60°.

The preheated hydrocarbon feedstock B listed in table 1 was charged into the riser and contacted with hot regenerated catalyst C listed in table 2 in the presence of steam with the result that some reactions took place. The reaction products were separated into isobutane enriched LPG, isoparaffin enriched gasoline and other products. Spent catalyst flowed into regenerator via stripping. After regeneration, the regenerated catalyst was recycled for use.

Operating conditions and product slate were listed in table 6. Gasoline properties were listed in table 7. Table 6 showed that 35.07 wt % of LPG was isobutane. Table 7 showed that gasoline had an isoparaffin content of 36.0 wt %, whereas olefin content was 28.1 wt %.

Comparative Example 3

The comparative example was conducted in a conventional pilot plant iso-diameter riser reactor. The catalyst and feedstock used were the same as that in example 3. Operating conditions and product slate were listed in table 6. Gasoline properties were listed in table 7. Table 6 showed that 15.74 wt % of LPG was isobutane. Table 7 showed that the gasoline had an isoparaffin content of 11.83 wt %, and an olefin content of 56.49 wt %.

Example 4

The example showed that hydrocarbon feedstock was converted to produce isobutane and isoparaffin enriched gasoline over different type catalysts in a pilot plant multi-cascade riser reactor in accordance with the present invention.

The reactor used in the example was the same as that in example 3. The feedstocks used were the mixture of 80 wt % of VGO A and 20 wt % of CGO C, and AR D, whose properties were listed in table 1. Operating conditions, catalyst types, product slate and gasoline properties were listed in table 8. Table 8 showed that about 28~32 wt % of LPG was isobutane, and the gasoline had an isoparaffin content of about 33~39 wt % and an olefin content of 16.0~27.0 wt %.

Example 5

The example showed that hydrocarbon feedstock was converted to produce isobutane and isoparaffin enriched gasoline in a pilot plant multi-cascade riser reactor wherein gasoline with higher olefin content acted as a quenching medium in accordance with the present invention.

The reactor, catalyst and feedstock were the same as those used in example 3. The gasoline with higher olefin content acting as quenching medium was that obtained in comparative example 3. The gasoline was injected into the bottom of the second reaction zone, other operating conditions were similar to those of example 2.

Operating conditions and product slate were listed in table 9. Gasoline properties were listed in table 10. Table 9 showed that 34.15 wt % of LPG was isobutane. Table 10 showed that the gasoline had an isoparaffin content of 43.86 wt %, and an olefin content of 20.51 wt %.

Example 6

The example showed that hydrocarbon feedstock was converted to produce isobutane and isoparaffin enriched gasoline in a pilot plant multi-cascade riser reactor in accordance with the present invention.

The total height of the multi-cascade riser is 15 meters in which the height of the prelift zone with a diameter of 0.025 meter is 1.5 meters, the height of the first reaction zone with a diameter of 0.025 meter is 4.5 meters, and the height of the second reaction zone with a diameter of 0.05 meter is 9 meters. The isotrapezia vertex angle a of the vertical section of the conjunct section between the first reaction zone and the second reaction zone is about 45°.

The catalyst and feedstock used were the same as those used in example 3. Operating conditions and product slate were listed in table 9. Gasoline properties were listed in table 10. Table 9 showed that 32.91 wt % of LPG was isobutane. Table 10 showed that gasoline had an isoparaffin content of 33.31 wt %, whereas olefin content was 26.51 wt %.

Example 7

The example showed that hydrocarbon feedstock was converted to produce isobutane and isoparaffin enriched gasoline in a pilot plant multi-cascade riser reactor in accordance with the present invention.

The reactor used was the same as that in example 3. The preheated hydrocarbon feedstock E listed in table 1 was charged into the first reaction zone and contacted with hot regenerated catalyst C listed in table 2 in the presence of steam with the result that cracking reaction took place, then the resultant mixture flowing into the second reaction zone was mixed with cooled regenerated catalyst via cooler. The reaction products were separated into isobutane enriched LPG, isoparaffin enriched gasoline and other products. Spent catalyst flowed into regenerator via stripping. After regeneration, the regenerated catalyst was divided into two parts, one was returned into the bottom of the first reaction zone, and the other part was cooled in catalyst cooler and recycled into the bottom of the second reaction zone for use.

Operating conditions, catalyst types, product slate and gasoline properties were listed in table 11. Table 11 showed that LPG had an isobutane content of about 35.49 wt %, whereas butylenes content was about 19.62 wt %, and that the gasoline had an isoparaffin content of 35.02 wt %, and an olefin content of 26.43 wt %.

Comparative Example 4

Compared with example 7, the process was operated in the same manner, except that the selected quenching medium injected into the second reaction zone was naphtha instead of the cooled regenerated catalyst.

Operating conditions, catalyst types, product slate and gasoline properties were listed in table 11. Table 11 showed that LPG had an isobutane content of about 26.53 wt %, whereas butylenes content was about 21.91 wt %, and that the gasoline has an isoparaffin content of 30.92 wt %, whereas olefin content was 30.22 wt %.

Example 8

The example showed that hydrocarbon feedstock was converted to produce isobutane and isoparaffin enriched gasoline in a pilot plant multi-cascade riser reactor in accordance with the present invention.

Compared with example 7, the process was operated in the same manner, except that the selected prelift medium for prelifting the cooled regenerated catalyst used as a quenching medium was naphtha instead of steam.

Operating conditions, catalyst types, product slate and gasoline properties were listed in table 11. Table 11 showed that LPG had an isobutane content of about 36.03 wt %, whereas butylenes content was about 19.50 wt %, and that the gasoline had an isoparaffin content of 37.74 wt %, and an olefin content of 23.78 wt %.

TABLE 1

| Feedstock No. | A | B | C | D | E |
|---|---|---|---|---|---|
| Feedstock Name | VGO | VGO | CGO | AR | VR |
| Density (20° C.), kg/m$^3$ | 873.0 | 890.5 | 869.6 | 897.4 | 920.9 |
| Viscosity, mm$^2$/s | | | | | |
| 80° C. | 13.01 | 7.93 | 6.66 | 54.20 | |
| 100° C. | 8.04 | 5.08 | 4.54 | 30.02 | 114.4 |
| Carbon Residue, wt % | 0.15 | 0.7 | 0.84 | 4.5 | 8.2 |
| Pour Point; ° C. | 50 | 40 | 33 | 47 | 2.5 |
| Basic nitrogen, ppm | 340 | | 1920 | | |
| Nitrogen, wt % | 0.10 | 0.16 | 0.29 | 0.27 | 0.33 |
| Sulfur, wt % | 0.073 | 0.53 | 0.13 | 0.14 | 0.21 |
| Carbon, wt % | 86.5 | 85.00 | 86.55 | 86.26 | 86.91 |
| Hydrogen, wt % | 13.24 | 12.62 | 13.03 | 12.91 | 12.55 |

TABLE 1-continued

| Feedstock No. | A | B | C | D | E |
|---|---|---|---|---|---|
| Metal Content, ppm | | | | | |
| Ni | <0.1 | 0.16 | 0.70 | 5.2 | 8.8 |
| V | <0.1 | 0.15 | <0.1 | <0.1 | 0.1 |
| Fe | 54 | — | 0.80 | 4.2 | 1.8 |
| Cu | <0.1 | — | #0.1 | <0.1 | <0.1 |
| Na | — | 0.45 | | 5.5 | 3.0 |
| Distillation. ° C. | | | | | |
| IBP | 346 | 242 | 238 | 324 | 415 |
| 10% | 411 | 322 | 328 | 408 | 545 |
| 30% | 437 | 380 | 363 | 486 | — |
| 50% | 462 | 410 | 382 | — | — |
| 70% | 489 | 437 | 409 | — | — |
| 90% | 523 | 480 | 429 | — | — |
| EP | 546 | 516 | — | — | — |

TABLE 2

| Catalyst No. | A | B | C | D |
|---|---|---|---|---|
| Trademark | CRC-1 | RHZ-200 | ZCM-7 | RAG-1 |
| Zeolite types | REY | REHY | USY | REY-USY-ZRP |
| Chemical Composition, wt % | | | | |
| Aluminum oxide | 26.5 | 33.0 | 46.4 | 44.6 |
| Sodium oxide | 0.19 | 0.29 | 0.22 | 0.13 |
| Ferric oxide | 0.09 | 1.1 | 0.32 | |
| Apparent Bulk Density, Kg/m$^3$ | 450 | 560 | 690 | 620 |
| Pore Volume, ml/g | 0.41 | 0.25 | 0.38 | 0.36 |
| Surface area, m$^2$/g | 132 | 92 | 1.64 | 232 |
| Attrition index, wt % hr$^{-1}$ | 4.2 | 3.2 | — | 2.5 |
| Particle size distribution, wt % | | | | |
| 0–40 $\mu$m | 7.3 | 15.2 | 4.8 | 13.1 |
| 40–80 $\mu$m | 43.7 | 55.1 | 47.9 | 54.9 |
| >80 $\mu$m | 44.3 | 27.3 | 47.3 | 32.0 |

TABLE 3

| | Example 1 | Comparative Example 1 |
|---|---|---|
| Reaction Temperature ° C. | | 530 |
| The first reaction zone | 550 | — |
| The second reaction zone | 510 | — |
| Reaction time, second | 5.5 | 3.5 |
| The first reaction zone | 2.0 | — |
| The second reaction zone | 3.5 | — |
| C/O | 7.82 | 6.7 |
| S/O | 0.1 | 0.1 |
| Product slate, wt % | | |
| Dry gas | 3.25 | 3.75 |
| LPG | 25.34 | 26.02 |
| in which isobutane | 5.25 | 2.33 |
| Gasoline | 47.34 | 46.55 |
| LCO | 10.32 | 10.10 |
| HCO | 5.95 | 5.25 |
| Coke | 7.40 | 7.86 |
| Loss | 0.40 | 0.47 |

TABLE 4

| | Example 1 | Comparative Example 1 |
|---|---|---|
| Density (20° C.), Kg/m³ | 729.8 | 711.3 |
| Octane Number | | |
| RON | 91.6 | 92.1 |
| MON | 80.7 | 80.5 |
| Induction Period, min | 695 | 535 |
| Existent Gum, mg/100 ml | 6 | 2 |
| Sulfur, wt % | 0.031 | 0.028 |
| Nitrogen, wt % | 0.0068 | 0.0041 |
| C, wt % | 86.65 | 85.98 |
| H, wt % | 13.34 | 13.86 |
| Distillation, ° C. | | |
| IBP | 47 | 41 |
| 10% | 61 | 54 |
| 30% | 74 | 65 |
| 50% | 97 | 86 |
| 70% | 131 | 119 |
| 90% | 173 | 160 |
| EP | 206 | 192 |
| Composition, wt % | | |
| Paraffins | 36.42 | 26.94 |
| n-paraffins | 4.50 | 4.88 |
| Iso-paraffins | 31.92 | 22.06 |
| Naphthene | 7.32 | 7.16 |
| Olefins | 29.32 | 47.65 |
| Aromatics | 26.94 | 18.25 |

TABLE 5

| | Example 2 | Comparative Example 2 |
|---|---|---|
| Reactor | Convention riser plus fluidized bed | Convention riser |
| Reaction Temperature ° C. | | 530 |
| The first reaction zone | 550 | — |
| The second reaction zone | 500 | — |
| C/O | 6.0 | 7.7 |
| Reaction time, second | 5.0 | 3.1 |
| The first reaction zone | 1.3 | — |
| The second reaction zone | 3.7 | — |
| S/O | 0.1 | 0.1 |
| Product slate, wt % | | |
| Dry gas | 2.88 | 2.95 |
| LPG | 25.69 | 28.08 |
| in which propylene | 8.23 | 9.21 |
| Isobutane | 5.96 | 2.18 |
| Gasoline | 43.82 | 40.63 |
| LCO | 12.01 | 11.69 |
| HCO | 7.43 | 8.58 |
| Coke | 8.17 | 7.64 |
| Loss | — | 0.43 |
| Gasoline Octane number | | |
| RON | 91.1 | 92.1 |
| MON | 80.7 | 80.5 |
| Gasoline Composition, wt % | | |
| Paraffins | 34.17 | 21.38 |
| n-paraffins | 4.01 | 4.08 |
| Iso-paraffins | 30.16 | 17.30 |
| Naphthene | 8.16 | 7.33 |
| Olefins | 28.63 | 45.30 |
| Aromatics | 29.04 | 25.99 |

TABLE 6

| Reactor | Example 4 Multi-Cascade Riser | Comparative Example 3 Conventional Riser |
|---|---|---|
| Reaction Temperature ° C. | | 495 |
| The first reaction zone | 545 | — |
| The second reaction zone | 495 | — |
| Reaction time, second | 4.5 | 2.9 |
| The first reaction zone | 1.0 | — |
| The second reaction zone | 3.5 | — |
| C/O | 4.5 | 4.5 |
| S/O | 0.05 | 0.05 |
| Product slate, wt % | | |
| Dry gas | 1.83 | 1.62 |
| LPG | 16.11 | 11.88 |
| in which isobutane | 5.65 | 1.87 |
| Gasoline | 46.86 | 41.59 |
| LCO | 18.44 | 22.81 |
| HCO | 12.77 | 18.76 |
| Coke | 3.88 | 2.86 |
| Loss | 0.11 | 0.48 |

TABLE 7

| Reactor | Example 4 Multi-Cascade Riser | Comparative Example 3 Conventional Riser |
|---|---|---|
| Density (20° C.), Kg/m³ | 743.6 | 749.8 |
| Gasoline Octane Number | | |
| RON | 90.5 | 91.0 |
| MON | 80.4 | 79.8 |
| Induction Period, min | >1000 | >485 |
| Existent Gum, mg/100 ml | 2.0 | 2.0 |
| Sulfur, wt % | 0.0095 | 0.012 |
| Nitrogen, wt % | 0.0028 | 0.0033 |
| C, wt % | 86.14 | 86.81 |
| H, wt % | 13.72 | 13.12 |
| Distillation, ° C. | | |
| IBP | 46 | 50 |
| 10% | 73 | 77 |
| 30% | 95 | 99 |
| 50% | 114 | 122 |
| 70% | 143 | 145 |
| 90% | 171 | 175 |
| EP | 202 | 205 |
| Composition, wt % | | |
| Paraffins | 41.01 | 15.81 |
| n-paraffins | 5.01 | 3.98 |
| Iso-paraffins | 36.00 | 11.83 |
| Naphthene | 7.2 | 6.50 |
| Olefins | 28.11 | 56.49 |
| Aromatics | 23.68 | 21.20 |

TABLE 8

| Catalyst Name | A | B | C | D | E |
|---|---|---|---|---|---|
| Feedstock | 80%A+ 20%C | 80%A+ 20%C | D | D | D |
| Reaction Temperature ° C. | | | | | |
| The first reaction zone | 540 | 540 | 550 | 545 | 550 |
| The second reaction zone | 490 | 490 | 500 | 495 | 500 |
| Reaction time, second | 3.7 | 3.7 | 5.0 | 5.0 | 5.0 |
| The first reaction zone | 1.0 | 1.0 | 1.0 | 1.0 | 1.0 |
| The second reaction zone | 2.2 | 2.2 | 3.5 | 3.5 | 3.5 |
| Outlet zone | 0.5 | 0.5 | 0.5 | 0.5 | 0.5 |
| C/O | 3 | 3 | 5 | 4 | 6.0 |
| S/O | 0.05 | 0.05 | 0.10 | 0.10 | 0.10 |

TABLE 8-continued

| Catalyst Name | A | B | C | D | E |
|---|---|---|---|---|---|
| Product slate, wt % | | | | | |
| Dry gas | 0.82 | 0.73 | 2.50 | 2.35 | 2.58 |
| LPG | 9.39 | 11.60 | 23.92 | 19.76 | 22.59 |
| in which isobutane | 2.94 | 3.63 | 7.87 | 6.43 | 6.44 |
| Gasoline | 45.62 | 49.34 | 46.95 | 44.94 | 47.82 |
| LCO | 19.68 | 18.87 | 10.99 | 12.36 | 11.99 |
| HCO | 21.86 | 17.00 | 6.61 | 11.28 | 7.02 |
| Coke | 2.63 | 2.46 | 9.03 | 9.31 | 8.00 |
| Gasoline octane number | | | | | |
| RON | 87.4 | 87.3 | 91.0 | 90.6 | 92.1 |
| MON | 78.1 | 77.7 | 80.0 | 80.4 | 81.2 |
| Gasoline composition, wt % | | | | | |
| Paraffins | 43.15 | 45.03 | 42.04 | 43.9 | 37.25 |
| n-paraffins | 8.20 | 8.53 | 3.84 | 4.98 | 3.88 |
| Iso-paraffins | 34.95 | 36.50 | 38.20 | 38.92 | 33.37 |
| Naphthene | 9.86 | 10.03 | 9.26 | 7.33 | 7.16 |
| Olefins | 23.93 | 22.60 | 16.14 | 25.17 | 26.55 |
| Aromatics | 23.06 | 22.34. | 32.56 | 23.6 | 29.04 |
| Benzene | 0.45 | 0.41 | 0.41 | 0.60 | 0.70 |

TABLE 9

| Operating Conditions | Example 5 | Example 6 |
|---|---|---|
| Reaction Temperature ° C. | | |
| The first reaction zone | 545 | 545 |
| The second reaction zone | 495 | 495 |
| Reaction time, second | 5.3 | 5.3 |
| The first reaction zone | 0.8 | 1.1 |
| The second reaction zone | 3.9 | 4.2 |
| Outlet Zone | 0.6 | — |
| C/O ratio | 5.0 | 5.0 |
| S/O ratio | 0.05 | 0.05 |
| Product slate, wt % | | |
| Dry gas | 1.78 | 2.31 |
| LPG | 17.51 | 18.23 |
| in which isobutane | 5.98 | 6.00 |
| Gasoline | 47.98 | 45.34 |
| LCO | 18.30 | 18.46 |
| HCO | 10.22 | 10.78 |
| Coke | 4.00 | 4.61 |
| Loss | 0.21 | 0.27 |

TABLE 10

| | Example 5 | Example 6 |
|---|---|---|
| Density (20° C.), Kg/m$^3$ | 745.3 | 746.2 |
| Octane Number | | |
| RON | 90.1 | 90.2 |
| MON | 80.9 | 80.9 |
| Induction Period, min | 800.0 | 750.0 |
| Existent Gum, mg/100 ml | 2.0 | 2.0 |
| Sulfur, wt % | 0.01 | 0.01 |
| Nitrogen, wt % | 0.003 | 0.003 |
| C, wt % | 86.51 | 86.63 |
| H, wt % | 13.42 | 13.32 |
| Distillation, ° C. | | |
| IBP | 48 | 44 |
| 10% | 75 | 71 |
| 30% | 97 | 93 |
| 50% | 118 | 113 |
| 70% | 144 | 142 |
| 90% | 173 | 170 |
| EP | 203 | 198 |

TABLE 10-continued

| | Example 5 | Example 6 |
|---|---|---|
| Composition, wt % | | |
| Paraffins | 47.87 | 37.29 |
| n-paraffins | 4.01 | 3.98 |
| Iso-paraffins | 43.86 | 33.31 |
| Naphthene | 7.45 | 8.03 |
| Olefins | 20.51 | 26.51 |
| Aromatics | 24.17 | 28.17 |

TABLE 11

| Operating Conditions | Example 7 | Comparative Example 4 | Example 8 |
|---|---|---|---|
| Reaction Temperature ° C. | | | |
| The first reaction zone | 560 | 560 | 560 |
| The second reaction zone | 510 | 510 | 510 |
| Reaction time, second | 5.3 | 5.0 | 5.3 |
| The first reaction zone | 1.0 | 1.0 | 1.0 |
| The second reaction zone | 3.7 | 3.5 | 3.7 |
| Outlet zone | 0.6 | 0.5 | 0.6 |
| C/O ratio | | | |
| The first reaction zone | 6.0 | 6.0 | 6.0 |
| The second reaction zone | 7.5 | 6.0 | 7.5 |
| S/O ratio | 0.1 | 0.1 | 0.1 |
| Product slate, wt % | | | |
| Dry gas | 3.24 | 3.01 | 3.34 |
| LPG | 17.33 | 15.15 | 18.43 |
| In which propylene | 6.15 | 4.02 | 6.64 |
| Isobutane | 3.40 | 3.32 | 3.60 |
| Gasoline | 43.16 | 43.44 | 42.01 |
| LCO | 16.13 | 17.63 | 16.03 |
| HCO | 9.02 | 9.58 | 9.01 |
| Coke | 11.07 | 10.92 | 11.12 |
| Loss | 0.05 | 0.27 | 0.06 |
| Gasoline properties | | | |
| RON | 90.0 | 91.0 | 90.0 |
| MON | 80.1 | 79.8 | 80.0 |
| Aromatics | 26.67 | 26.35 | 26.82 |
| Olefins, wt % | 26.43 | 30.22 | 23.78 |
| Paraffins, wt % | 39.28 | 35.45 | 41.75 |
| n-paraffins, wt % | 4.26 | 4.53 | 4.01 |
| Iso-paraffins, wt % | 35.02 | 30.92 | 37.74 |
| Naphthene, wt % | 7.62 | 7.98 | 7.65 |

What is claimed is:

1. A process for catalytic conversion of hydrocarbon feedstock to isobutane and isoparaffin-enriched gasoline comprising the steps of:

(a) contacting the hydrocarbon feedstock in a first reaction zone with hot regenerated catalyst in a lower part of a reactor at catalytic cracking reaction conditions including cracking temperatures and cracking reaction times and which catalytic cracking reaction conditions are selected to produce a cracking reaction on said hydrocarbon feedstock and produce a mixture of vapors and coke-deposited catalyst; and (b) up-flowing the mixture of vapors and coke deposited catalyst into a second reaction zone at hydrogen transfer and isomerization reaction conditions including hydrogen transfer and isomerization reaction temperatures that are lower than the cracking temperatures and hydrogen transfer and isomerization reaction times that are longer than the cracking reaction times, and which hydrogen transfer and isomerization reaction conditions are selected to produce a hydrogen transfer and isomerization reaction on said vapors and produce reaction products comprising isobutane and isoparaffin enriched gasoline.

2. The process according to claim 1, wherein the catalytic cracking reaction conditions include a cracking reaction temperature within the range of about 530° C. to 620° C., a cracking reaction time within the range of about 0.5 second to 2.0 seconds and a C/O ratio within the range of about 3:1 to 15:1, and hydrogen transfer and isomerization reaction conditions include a hydrogen transfer and isomerization reaction temperature within the range of about 420° C. to 530° C., a hydrogen transfer and isomerization reaction time within the range of about 2 seconds to 30.0 seconds and a C/O ratio within the range of about 3:1 to 18:1.

3. The process according to claim 2, wherein catalytic cracking reaction conditions include a cracking reaction temperature within the range of about 550° C. to 600° C., a cracking reaction time within the range of about 0. 8 second to 1. 5 seconds, a C/O ratio within the range of about 4:1 to 12:1, and hydrogen transfer and isomerization reaction conditions include a hydrogen transfer and isomerization reaction temperature within the range of about 460° C. to 510° C., a hydrogen transfer and isomerization reaction time within the range of about 3 seconds to 15 seconds and a C/O ratio within the range of about 4:1 to 15:1.

4. The process according to claim 1, wherein said the first and second reaction zones are carried out in reactor configurations selected from the group consisting of an iso-diameter riser, an iso-linear-velocity riser, a multi-cascade riser, a fluidized bed, and a combination reactor of an iso-diameter riser and a fluidized bed.

5. The process according to claim 4, wherein said iso-diameter riser or said iso-linear velocity riser includes a prelift zone, the first reaction zone for the catalytic cracking reaction, and the second reaction zone for the hydrogen transfer and isomerization reaction arranged respectively from bottom to top, and wherein said fluidized bed is includes the first reaction zone for the catalytic cracking reaction, and the second reaction zone for the hydrogen transfer and isomerization reaction arranged respectively from bottom to top and in which the height ratio of the first reaction zone to the second reaction zone is 10~40:90~60.

6. The process according to claim 5, further comprising the step of quenching between the first reaction zone and the second reaction zone.

7. The process according to claim 4, wherein the reactor configuration is a combination reactor of an iso-diameter riser and a fluidized bed and wherein the iso-diameter riser is located below the fluidized bed and comprises the first reaction zone and the fluidized bed comprises the second reaction zone.

8. The process according to claim 7, further comprising the step of quenching between the first reaction zone and the second reaction zone.

9. The process according to claim 4, wherein the reactor configuration is a multi-cascade riser reactor and said multi-cascade riser reactor has a height of from about 10 meters to about 60 meters and contains a prelift zone, the first reaction zone, and the second reaction zone and wherein the second reaction zone includes a diameter enlarged with respect to an outlet zone having a comparatively smaller diameter, and a disengager linked to the outlet zone with a horizontal tube.

10. The process according to claim 9, wherein the diameter ratio of said first reaction zone to said prelift zone is about 1~2:1 and the height of the first reaction zone is about 10%~30% of the height of the riser, and the diameter of said prelift zone is 0.02~5 meters.

11. The process according to claim 9, wherein the diameter ratio of said second reaction zone to said first reaction zone is about 1.5~5.0:1 and the height of the second reaction zone is about 30%~60% of the height of the riser reactor.

12. The process according to claim 9, wherein the said multi-cascade riser reactor further comprises a first conjunct section between the first reaction zone and the second reaction zone and said first conjunct section is a circular truncated cone whose vertical section isotrapezia vertex angle a is between about 30°~80°, and the multi-cascade riser reactor further comprises a second conjunct section between the second reaction zone and the outlet zone and said second conjunct section is a circular truncated cone, whose vertical section isotrapezia base angle β is between about 45°~85°.

13. The process according to claim 12, further comprising the step of quenching between the first reaction zone and the second reaction zone and wherein said first conjunct section further comprises one or more inlets for introduction of quenching media.

14. The process according to claim 6, wherein the step of quenching comprises at least the step of introducing quenching media selected from the group consisting of quenching liquid, cooled regenerated catalyst, cooled semi-regenerated catalyst, fresh catalyst, and the mixtures thereof.

15. The process according to claim 8, wherein the step of quenching comprises at least the step of introducing quenching media selected from the group consisting of quenching liquid, cooled regenerated catalyst, cooled semi-regenerated catalyst, fresh catalyst, and the mixtures thereof.

16. The process according to claim 13, wherein the step of quenching comprises at least the step of introducing quenching media selected from the group consisting of quenching liquid, cooled regenerated catalyst, cooled semi-regenerated catalyst, fresh catalyst, and the mixtures thereof.

17. The process according to claim 14, wherein said quenching media is a quenching liquid selected from the group consisting of LPG, naphtha, stabilized gasoline, light cycle oil, heavy cycle oil, water, and mixtures thereof.

18. The process according to claim 14, further comprising the steps of regenerating the catalysts in a primary and secondary stage and cooling each to produce said cooled regenerated and semi-regenerated catalysts.

19. The process according to claim 1, wherein the hydrocarbon feedstock is selected from the group consisting of atmospheric gas oils, naphtha, catalytic gasoline, diesel, vacuum gas oil, atmospheric residue or vacuum residue, coker gas oil, deasphalted oil, hydrotreated residue, hydrocracked residue, shale oil, and mixtures thereof.

20. The process according to claim 1, wherein the catalysts comprise amorphous silica-alumina catalysts or zeolite catalysts selected from the group consisting of Y, HY, USY, or ZSM5 series zeolites and in either case optionally containing at least one member selected from the group consisting of rare earth, phosphorous, and mixtures thereof.

21. The process according to claim 1, wherein catalysts entering into different reaction zones are of the same kind or of different kinds.

22. The process according to claim 14, wherein catalysts entering into different reaction zones are of the same kind or of different kinds.

23. The process according to claim 18, wherein catalysts entering into different reaction zones are of the same kind or of different kinds.

24. The process of claim 1 further comprising the steps of separating the reaction products, stripping the catalyst, and regenerating the catalyst for recycle.

25. The process of claim 6 further comprising the step of removing heat from the second reactor zone by a heat exchanger having a height that is about 50%~90% of the height of the second reaction zone.

26. The process of claim 8 further comprising the step of removing heat from the second reactor zone by a heat exchanger having a height that is about 50%~90% of the height of the second reaction zone.

27. The process of claim 13 further comprising the step of removing heat from the second reactor zone by a heat exchanger having a height that is about 50%~90% of the height of the second reaction zone.

* * * * *

UNITED STATES PATENT AND TRADEMARK OFFICE

CERTIFICATE OF CORRECTION

PATENT NO. : 6,495,028 B1
DATED : December 17, 2002
INVENTOR(S) : Youhao Xu et al.

It is certified that error appears in the above-identified patent and that said Letters Patent is hereby corrected as shown below:

Title page,
Item [75], Inventors, please replace the name "Raichi Zhang" with -- Ruichi Zhang --.

Signed and Sealed this

Tenth Day of June, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,495,028 B1
APPLICATION NO. : 09/556079
DATED : December 17, 2002
INVENTOR(S) : Youhao Xu et al.

It is certified that error appears in the above-identified patent and that said Letters Patent is hereby corrected as shown below:

On the Title Page, Item (73)

Please replace "China Petroleum Corporation, Beijing (CN); Research Institute of Petroleum Processing, Beijing (CN)" with --China Petrochemical Corporation, Beijing (CN); Research Institute of Petroleum Processing, Sinopec, Beijing (CN)--.

Signed and Sealed this
Twenty-eighth Day of June, 2011

David J. Kappos

David J. Kappos
*Director of the United States Patent and Trademark Office*